United States Patent [19]

Weems

[11] Patent Number: 4,972,805

[45] Date of Patent: Nov. 27, 1990

[54] METHOD AND APPARATUS FOR REMOVING FOREIGN MATTER FROM HEAT EXCHANGER TUBESHEETS

[75] Inventor: Sterling J. Weems, Chevy Chase, Md.

[73] Assignee: MPR Associates, Inc., Washington, D.C.

[21] Appl. No.: 473,433

[22] Filed: Feb. 1, 1990

[51] Int. Cl.[5] ..... F22B 37/48

[52] U.S. Cl. ..... 122/383; 122/381; 122/382; 134/22.12; 134/22.18; 134/37; 165/95; 376/316

[58] Field of Search ..... 134/22.12, 22.18, 37; 376/316; 122/381, 382, 383; 165/95

[56] References Cited

U.S. PATENT DOCUMENTS 4,715,324 12/1987 Muller et al. ..... 122/381

4,756,770 7/1988 Weems et al. ..... 122/383 X 4,899,697 2/1990 Franklin et al. ..... 122/382 X

*Primary Examiner*—Edward G. Favors

*Attorney, Agent, or Firm*—Epstein, Edell & Retzer

[57] ABSTRACT

Built-up deposits on the top surface of a tubesheet and on adjacent tube sections in a tube bundle heat exchanger are removed by inducing vigorous turbulent flow of cleaning liquid radially along the surface of the tubesheet by repetitively and periodically injecting gas pulses into the liquid to form an expanding and retracting gas bubble proximate the plate center. The gas pulse rise time is smoothed by controlling the actuation time of a discharge valve and by a surge volume downstream of the valve to thereby avoid harmful pressure shock waves in the heat exchanger. The cleaning liquid is recirculated through an external filter loop to remove suspended foreign materials dislodged by the turbulent flow.

37 Claims, 3 Drawing Sheets

METHOD AND APPARATUS FOR REMOVING FOREIGN MATTER FROM HEAT EXCHANGER TUBESHEETS

BACKGROUND OF THE INVENTION

1. Technical Field:

The present invention relates generally to an improved method and apparatus for removing foreign matter, such as the products of oxidation, corrosion and sedimentation, from interior surfaces of heat exchanger vessels. The present invention has particular utility in cleaning a nuclear steam generator or other tube bundle heat exchanger by removing foreign matter accumulating on the tubesheet and on sections of the tubing adjacent the tubesheet. Other surface areas within the heat exchanger are also efficiently cleaned by the method and apparatus of the present invention.

2. Discussion of the Prior Art:

Heat exchanger-type steam generators employed in nuclear power generating systems include a primary system made up of multiple individual tubes supported on a thick metal tubesheet or base, the tubes serving as conduits for circulating primary fluid. A secondary system includes a vessel containing a secondary fluid surrounding the tubes. Thermal energy is transferred from the primary fluid in the tubes to the surrounding secondary fluid to ultimately provide the steam from which output power is derived. During operation of these steam generators there is a normal build-up of foreign matter, such as mud, sludge, tube scale and deposits of iron oxides and other chemicals, on the top surface of the tubesheet and between the closely spaced tubes. A detailed discussion of this build-up is found in U.S. Pat. Nos. 4,320,528 and 4,655,846 (both to Scharton et al). It is necessary to remove the built-up foreign material on a regular basis for a number of reasons. First, if not removed, the foreign material tends to corrode the tubes, particularly in the region of the tubesheet. Second, the foreign material interferes with the heat exchange function of the steam generator by preventing direct contact between the secondary fluid and the tubes.

In U.S. Pat. No. 3,438,811 (Harriman), a method is disclosed whereby the cleaning of internal surfaces of high pressure steam generating equipment is performed by a chemical cleaning solution. For the most part, chemical cleaning methods are less desirable than the less costly mechanical methods and generally involve a much greater risk of damage to the heat exchanger components due to chemical interaction with the tubes, etc.

Another prior art system for cleaning high pressure heat exchangers is disclosed in U.S. Pat. No. 4,320,528 (Scharton et al) and combines ultrasonic energy and a chemical solvent. Chemical cleaning is undesirable for the reason stated above. Ultrasonic cleaning has an inherent problem in that the ultrasonic energy tends to decay as it travels through the liquid medium so that the cleaning forces are strong near the transducer but relatively weak at the target areas. When cleaning a steam generator of the type described, the ultrasonic transducer must be located at the periphery of the tube bundle because there is insufficient space between tubes to position the transducer within the bundle. Consequently, high energy levels are received at the tubes near the source, tending to damage these tubes unless the applied energy is maintained relatively low. However, the low applied energy level is insufficient to effect cleaning at the center of the tubesheet and within the bundle where cleaning energy is most required. The problem, then, is how to apply sufficiently large ultrasonic energy levels to the parts requiring cleaning without damaging parts located proximate the ultrasonic energy source.

Another prior art steam generator cleaning approach is disclosed in U.S. Pat. No. 4,645,542 (Scharton et al). According to the method disclosed in this patent, repetitive explosive shock waves are introduced into the liquid-filled steam generator chamber by an air gun. The shock waves travel through the liquid and are intended to impinge upon the surfaces to be cleaned in order to loosen the products of corrosion, oxidation and sedimentation deposited and accumulated thereon. The shock wave approach, however, suffers from the same major disadvantage described above for ultrasonic cleaning, namely: space requirements demand that the pressure wave source be located outside the tube bundle, resulting in insufficient cleaning energy reaching the tubes at the bundle interior unless the source energy is so high as to risk damage to tubes located near the source.

U.S. Pat. No. 4,655,846 (Scharton et al) discloses another pressure shock wave cleaning technique. Repetitive pressure pulse shock waves are generated by an air gun, or the like, located inside or outside the chamber. The liquid in the chamber can be at a level equal to or above the support plate to be cleaned and conducts the shock waves to that plate. The liquid is continuously circulated through an external path including filters and/or ion exchange units to remove foreign materials loosened by the shock waves. Again, the use of shock waves at sufficient pressure to clean interior components carries the risk of damage to components located proximate the shock wave source.

The water-slap method disclosed in U.S. Pat. No. 4,756,770 (Weems et al) effects cleaning by repetitive impacts against the surface to be cleaned by a rapidly rising surface of a pool of liquid disposed in the steam generator chamber. Surfaces cleaned in this manner include horizontal support plates and nearby tube sections. The surfaces to be cleaned must initially be located at least a few inches above the surface of the pool of liquid so that the pool can be accelerated upwardly and create the necessary impact. One technique for achieving the desired upward acceleration of the liquid is repetitive injection of nitrogen gas deep within the pool to form a bubble that drives the pool upwardly. The liquid is typically water and is continuously circulated through an external path wherein solid particles are removed. It is impossible to clean the top surface of the tubesheet and adjacent tube sections with the water slap method. Specifically, the top surface of the tubesheet constitutes the bottom of the chamber in which the water pool sits, thereby precluding locating the pool surface a few inches away from the tube sheet top surface as would be required by the water slap method to achieve the intended acceleration and impact. On the other hand, it is the very location of the tubesheet at the bottom of the chamber that causes foreign matter to accumulate thereon, and on adjacent tube sections, so as to require frequent cleaning.

Another known method for cleaning steam generators, disclosed in U.S. Pat. No. 4,079,701 (Hickman et al), is called sludge lancing wherein cleaning is effected by flow impingement and hydraulic drag forces. The components to be cleaned by this process, namely support plates, tubesheets and possibly tubes, are not submerged. Rather, a nozzle directs liquid (e.g., water) jets to impinge upon the areas to be cleaned. Only small localized areas can be cleaned at any one time, and the nozzles must be moved about within the heat exchanger to clean all of the desired surfaces. In order to provide access to these surfaces, it is necessary to cut a relatively large number of access holes in the pressure retaining shell of the heat exchanger so that nozzles and tubing can be appropriately oriented. These holes must be plugged or otherwise sealed after the cleaning process. The cutting and plugging requirement adds significantly to the overall cost of the cleaning process.

OBJECTS AND SUMMARY OF THE INVENTION

It is therefore an object of the present invention to provide a method and apparatus for efficiently and effectively removing foreign matter from a tubesheet and adjacent tube sections in a high pressure steam generator without risking damage to interior components of the steam generator and without requiring holes to be cut in the steam generator housing.

It is another object of the present invention to provide a mechanical, as opposed to chemical, method and apparatus for cleaning the interior surfaces of a heat exchanger whereby the aforementioned prior art problems and disadvantages are eliminated.

In accordance with the present invention, nitrogen or other gas is repetitively injected into a body of water located within the heat exchanger at a location in the middle of the tube bundle and just above the tubesheet. The injection pipe may be installed between tubes in the bundle, particularly where one row of tubes is omitted by design as is common to provide access space for inspection equipment. The injected gas displaces the water to create a generally radial water flow through the bundle with turbulence about each tube. At the termination of each gas injection portion of the cycle, the radial flow reverses; that is, the flow direction becomes radially inward as the nitrogen bubble pressure decreases. The resulting reversing turbulent flow at substantial velocity dislodges foreign matter from the tubesheet and adjacent tube sections, the removed matter being kept in suspension in the liquid. The flow is also caused to proceed out to the annulus region between the shroud and vessel shell and to flow up and down within this region to effect cleaning therein. The liquid itself is recirculated by means of a pump in an external recirculation loop containing a filter to remove the suspended foreign matter detached from the tubesheet and other surfaces in the heat exchanger. Return flow of filtered water is injected tangentially and downward within the annulus region outside the shroud to sweep the annulus region without impinging excessively on the tubes. The gas injection tube and the inflow and outflow tubes for the liquid recirculation loop are preferably all disposed in a common port in the steam generator housing.

The hydrodynamic forces applied to the surfaces within the steam generator are maximum at the bundle interior where the cleaning action is most needed. The radially outward and inward flow created by the repetitive injection of gas dislodges the accumulated matter from the top of the tubesheet more efficiently and with less risk of tube damage than is possible in any of the prior art cleaning techniques.

BRIEF DESCRIPTION OF THE DRAWINGS

The above and still further objects, features and advantages of the present invention will become apparent upon consideration of the following detailed description of a specific embodiment thereof, particularly when taken in conjunction with the accompanying drawings wherein like reference numerals in the various figures are utilized to designate like components, and wherein.

DESCRIPTION OF THE PREFERRED EMBODIMENT

Figure 1:
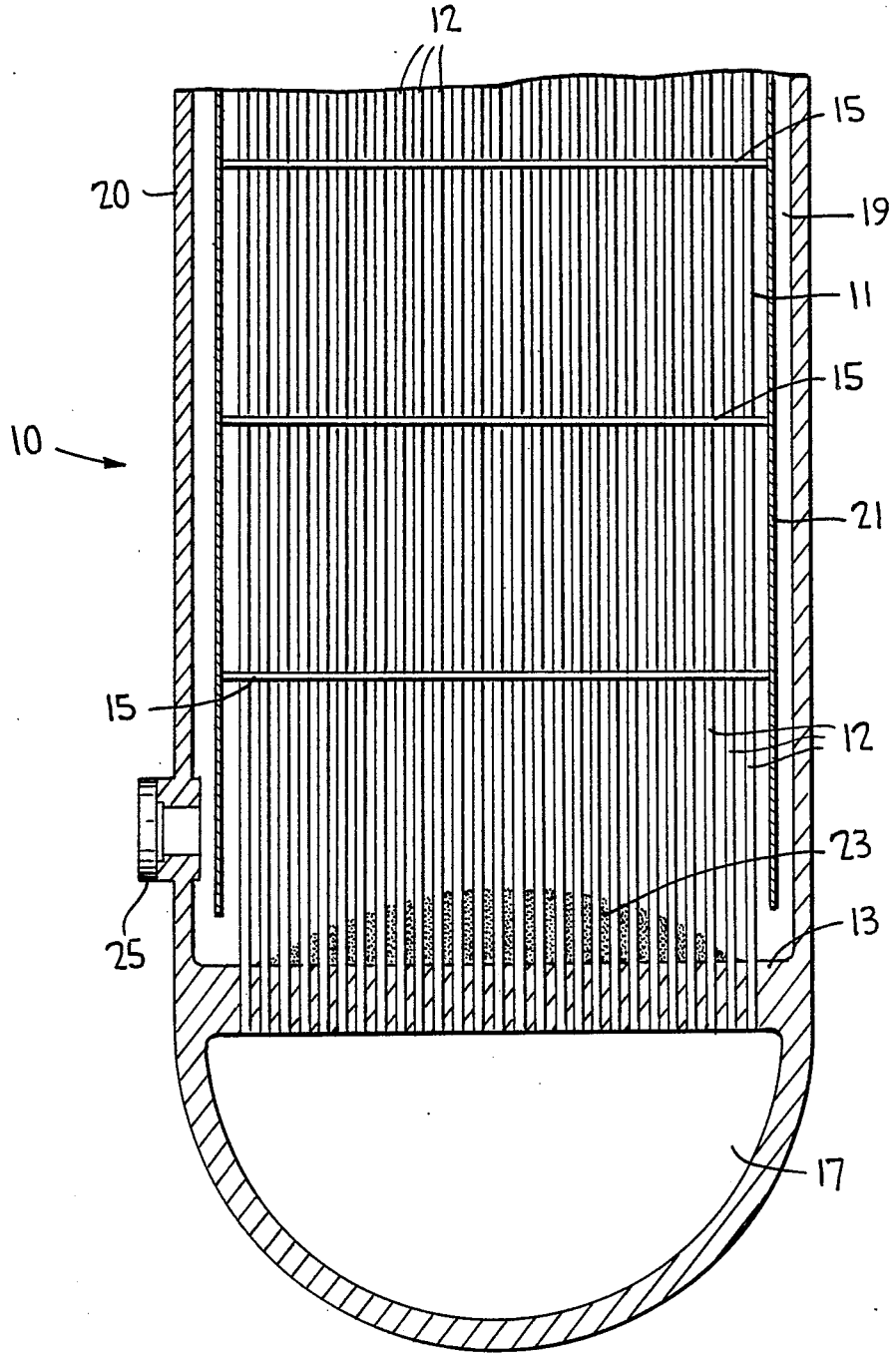
FIG. 1 is a fragmentary view in longitudinal section of a steam generator of the type to be cleaned pursuant to the present invention showing the accumulation of foreign matter on the generator tubesheet.

Referring specifically to FIG. 1 of the accompanying drawings, a large scale conventional tube bundle heat exchanger 10 typically includes a bundle 11 of multiple vertical tubes 12 retained between a top tubesheet (not shown) and a bottom tubesheet 13. Alternatively, the tubes may be U-shaped and supported only by a bottom tubesheet; the present invention is useful with both types of steam generators, although the following discussion relates specifically to the vertical bundle type of generator. The tubes are additionally supported by a plurality of intermediate horizontal support plates 15 located at spaced vertical locations within the heat exchanger housing. Heated primary coolant fluid, typically from a nuclear reactor core, enters heat exchanger 10 from above tube bundle 11 and flows through the tubes 12 and bottom tubesheet 13 to an outlet chamber 17 from which the coolant is discharged by nozzles (not shown). Secondary fluid, typically water, is delivered via a plurality of inlet ports (not shown) into a downcomer annulus region 19 defined between the lower outer casing 20 of the heat exchanger vessel and an annular shroud 21 surrounding the lower part of tube bundle 11. Secondary fluid thusly injected moves downwardly through downcomer annulus region 19 to tubesheet 13 and then upwardly between the tubes 12 in bundle 11. For this purpose there are flow holes defined in support plates 15 surrounding each of the tubes 12. Thermal energy is transferred from the primary fluid in tubes 12 to the secondary fluid flowing around the outside of these tubes, the thermal energy absorbed by the secondary fluid eventually being converted to steam.

During operation of heat exchanger 10, foreign matter 23, such as mud, sludge, oxides and other contaminates introduced with the secondary fluid, can become deposited on the top surface of tubesheet 13 and the adjacent sections of tubes 12 in bundle 11. The foreign matter also collects on other tube sections, in annulus region 19, and on support plates 15. However, because tubesheet 13 is at the bottom of the vessel, a greater build-up occurs on the top surface of tubesheet 13 and the adjacent tube sections. As described above, because of the difficulty of obtaining access to the bundle interior adjacent tubesheet 13, it is particularly difficult to remove foreign matter 23 that builds-up in that region.

Figure 2:
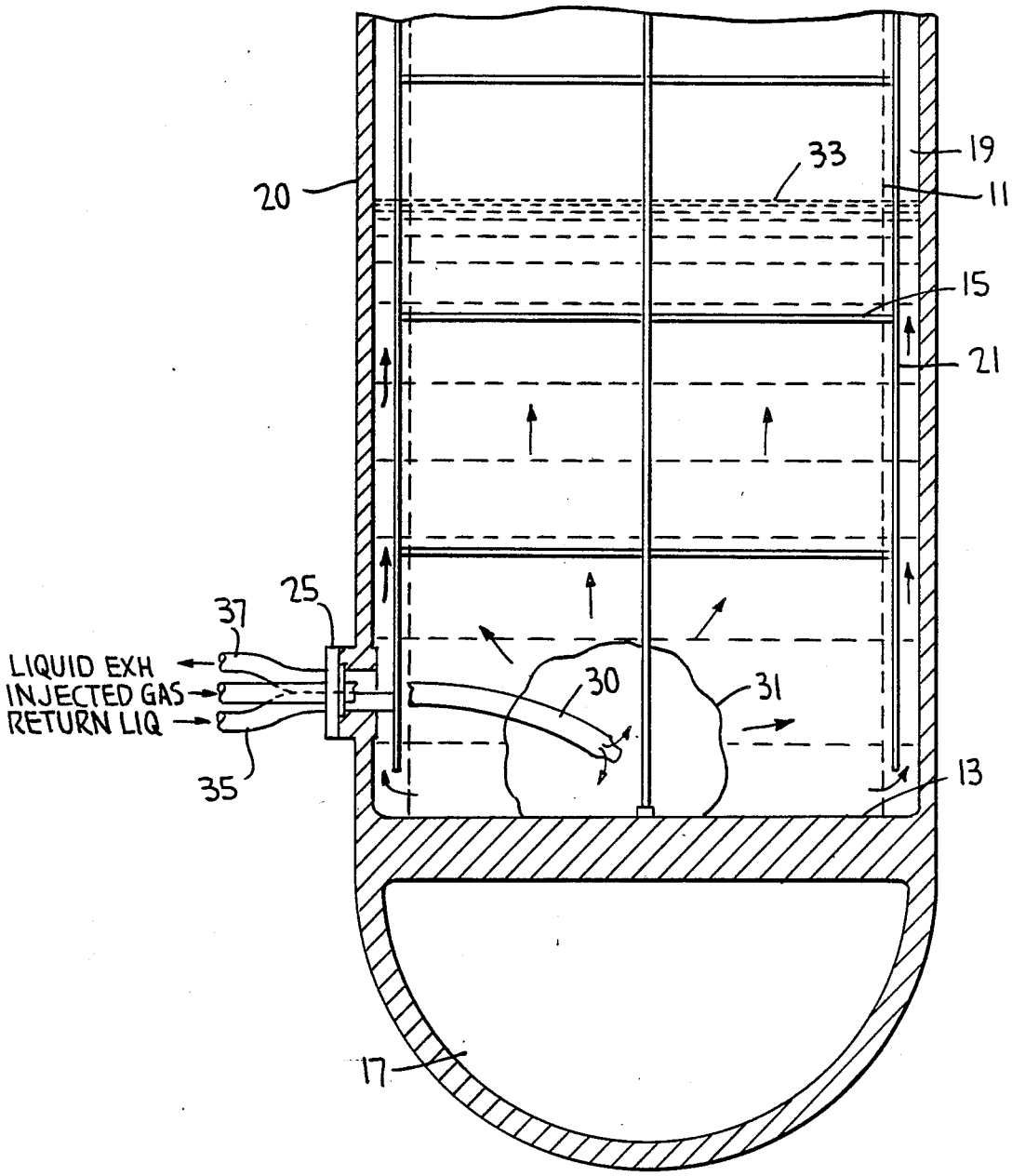
FIG. 2 is a fragmentary view similar to FIG. 1 but diagrammatically illustrating the cleaning process of the present invention.

To illustrate the cleaning method of the present invention, reference is made to FIG. 2 of the accompanying drawings wherein the tube bundle 11 is merely shown diagrammatically by dashed lines to facilitate understanding of the described method. Water or other cleaning liquid 33 is provided in the chamber to a predetermined level considerably above tubesheet 13 and intermediate any two support plates 15. An injector pipe 30 extends into the heat exchanger from a handhole or similar port 25 provided through housing 20 at a location well below the surface of cleaning liquid 33 and just above tubesheet 13. Injector pipe 30 extends through a suitably provided opening in shroud 21 into tube bundle 11 between the tubes 12, particularly where a row of tubes is deleted as is commonly done to provide access space for inspection equipment. The downstream end of injector pipe 30 terminates proximate the radial center of the chamber at or just above tubesheet 13. In a manner described below, a prescribed volume of pressurized gas, such as nitrogen, is repetitively injected via pipe 30 to create a gas bubble 31. As the bubble expands in the cleaning liquid 33, it causes the liquid to flow substantially radially outward from the bubble. When the gas injection terminates, bubble 31 partially collapses and causes the liquid to flow substantially radially inward to fill the volume previously occupied by the collapsing bubble. Part of this reciprocating and turbulent radial flow is along the tubesheet 13 in the spaces between tubes 12. This turbulent flow at significant velocity dislodges deposits of foreign matter on the tubesheet and on adjacent sections of tubes 12, particularly deposits of magnetite sludge which are then kept in suspension in the moving cleaning fluid. It is to be understood that although the preferred embodiment involves injecting the pressurized gas at a central location in the tube bundle, the alternating radial flow can be provided by repetitively injecting gas at a plurality of peripheral locations about the tube bundle.

In a typical operating mode, flow velocities of the cleaning liquid brought about by the expanding and retracting gas bubble are in the range of ten to thirty feet per second. The velocity distribution along the top surface of tubesheet 13 is approximately bell-shaped with the maximum flow rate at the center of the bundle and the minimum flow rate at the bundle periphery where sludge accumulation is considerably less. In situations where lower liquid flow rates are effective to dislodge sludge build-up, it is only needed to reduce the pressure of the injected gas in order to achieve the desired lower liquid flow rate. As a minimum, the flow rate should be at least 1 to 2 feet per second to effect the desired cleaning action.

The use of reciprocating radial water flow to dislodge deposits has significant advantages over prior art techniques. To begin with, a substantial water flow velocity can be generated across the entire tubesheet surface with a minimum of equipment and minimal perturbation of the steam generator. For example, only a relatively small gas injector tube 30, operating only through one steam generator handhole 25, is required to wash the tubesheet with substantial water flow velocities. By comparison, these water flow velocities would require a very high flow rate produced by an external circulation loop capable of flow rates of thousands of gallons per minute to achieve similar velocities if the tubesheet were to be washed solely by bringing water in from outside the steam generator to effect the necessary washing action.

In addition, the process of the present invention generates substantial crossflows through the tube bundle for only relatively short times, thereby reducing the tendency for tube vibration instability as compared with continuous flow processes wherein tube vibration amplitudes may have sufficient time to build-up. Further, the present invention results in substantial displacements of water volumes (e.g., up to ten cubic feet) in regions where it is desired to dislodge, suspend and transport particles of sludge, in direct contrast to some processes wherein displacements are too small to suspend and transport the sludge. Importantly, the cleaning process of the present invention does not generate hydrodynamic pressure pulses (i.e., sonic shock waves); consequently, stresses on the tubes 12 are very low as opposed to the significant and potentially damaging loads produced by shock wave techniques. Finally, the process of the present invention does not produce impact (i.e., water-slap) loads on the support plates 15 since the water surface is located well away from any support plate. It is desirable to reduce loads on the support plates in view of the fact that they may well be the limiting component with regard to hydrodynamic loads involved in the process.

Figure 3:
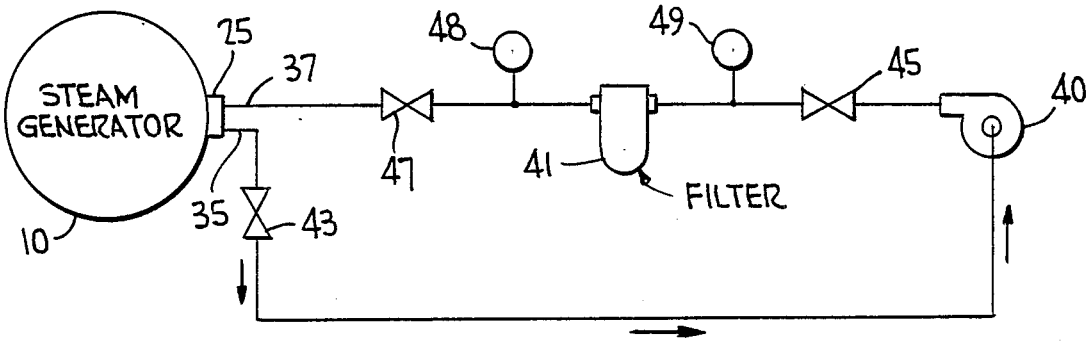
FIG. 3 is a schematic flow diagram of the liquid recirculation loop employed in the present invention.

The turbulent reciprocating radial cleaning liquid flow above the tubesheet suspends dislodged deposits and transports them out to shroud 21. In addition, cleaning liquid in the annulus region 19 reciprocates up and down with expansion and retraction of gas bubble 31. By way of example, flow rates in the annulus region 19 are typically in the range of fourteen to thirty feet per second. By connecting an exhaust pipe 37 and a supply pipe 35 to the vessel via handhole 25, a net flow of cleaning fluid can be established through the vessel by a recirculating loop. A suitable cleaning liquid recirculating loop is illustrated in FIG. 3 and includes as its primary components a pump 40 and filter 41. Additionally, the loop may include appropriate isolation valves 43, 45, 47 and gauges 48, 49 to monitor flow and pressure parameters. Pump 40 produces a net flow through the loop and the steam generator to carry the suspended dislodged materials to filter 41 where the materials are removed from the recirculated liquid. The return flow is injected via supply tube 35 in a generally tangential and downward direction within annulus region 19 outside shroud 21. This assures that the surfaces in the annulus region are swept clean by the tangential flow without excessive forces impinging upon the tubes 12. Access for the liquid flow tubes 35 and 37 and the gas injection tube 30 via handhole 25 employs a special handhole cover with appropriate fittings, thereby minimizing perturbation of the steam generator while affording the functions of loosening, transporting and removing the foreign material.

The recirculation loop is capable of removing substantially all of the loosened deposits from the recirculating cleaning liquid. In typical systems, the removed material ranges from tube scale pieces approximately 0.010 inch thick by approximately $\frac{1}{8}$ inch square to very fine magnetite particles a few microns in size and in concentrations of approximately three hundred parts per million. A powdered resin filter demineralizer may be employed if it is desired to also remove ionic impurities.

Figure 4:
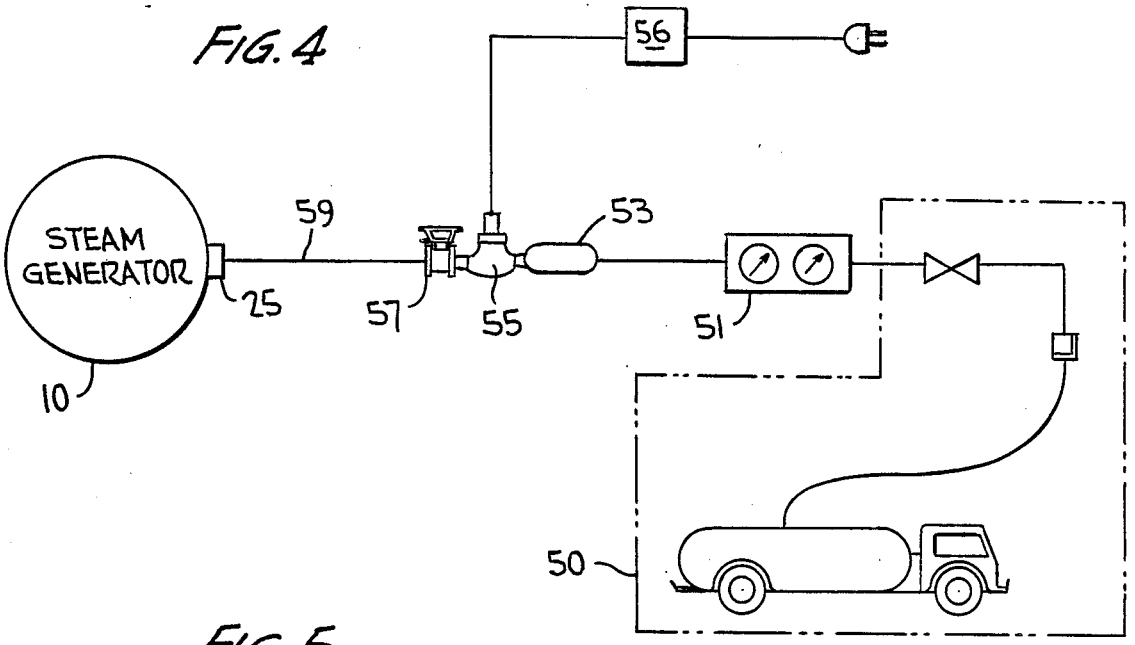
FIG. 4 is a schematic flow diagram of a gas injection system that may be used with the present invention.
Figure 5:
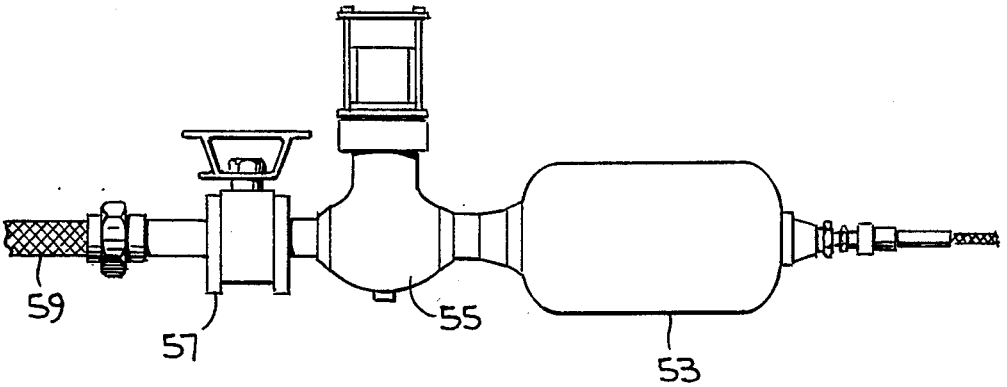
FIG. 5 is a side view in elevation of gas injection components employed in the injection system illustrated in FIG. 4.

The gas injection system illustrated in FIG. 4 includes a high pressure source of gas, such as nitrogen, comprising a tank of the gas under pressure and appropriate pressure control and safety relief valves feeding an isolation valve. A pressure regulator 51 receives the pressurized gas and adjusts the pressure under manual control. Gas accumulator 53 receives the pressure-regulated gas and delivers it to a solenoid discharge valve 55 selectively operated by an electrical control unit 56. An isolation valve 57 located downstream of the discharge valve supplies the pressurized gas to a hose 59 connected via handhole 25 to the gas injector tube 30 (FIG. 2) located inside the steam generator. Gas accumulator 53, solenoid valve 55 and isolation valve 57 are preferably part of a single assembled unit as illustrated in FIG. 5. The solenoid valve is provided with a small vent or leakage path serving as a bypass between the upstream and downstream sides of the valve when the valve is closed. The purpose of this bypass is to assure that the injector pipe 30 (FIG. 2) contains only gas and is free of cleaning liquid prior to actuation of the solenoid valve.

In operation of the gas injection system, initially accumulator 53 is filled with nitrogen at a pressure equal to the regulated source pressure. Solenoid discharge valve 55 is closed, and the surge volume, (i.e., comprising the injection pipe 30 and hose 59, etc., located downstream of solenoid valve 55) are full of nitrogen gas at the "ambient" pressure within the steam generator. This "ambient" pressure is the sum of the steam generator gas space pressure above the cleaning liquid level and the hydrostatic head due to the water level itself. A small flow of nitrogen gas through the bypass path assures that the surge volume is gas-filled; this bypass flow produces a relatively small stream of bubbles emitted from the downstream end of injection pipe 30 within the steam generator.

In order to initiate gas injection, the solenoid discharge valve 55 is opened under the control of circuit 56, allowing the high pressure gas to discharge from accumulator 53 into the surge volume (i.e., hose 59, injector tube 30, etc.) and the steam generator 10. The pressure in the surge volume increases and gas is expelled to the steam generator, creating a bubble 31 (FIG. 2) in the waterpool. The inertia of the water constrains the bubble so that its pressure also increases, but the increase is only to a value less than that in the surge volume. The increase in the surge and bubble pressures are softened by the presence of the surge volume acting as an absorber between accumulator 53 and the steam generator. In effect, this softening combines with the rate of actuation of valve 55, to slow the rise time of the pressure pulse and thereby prevent sonic-type "shock" loads in the steam generator.

The increase in bubble pressure accelerates water in the steam generator upward until the bubble pressure peaks and eventually begins to decrease due to the pool expansion. The surge volume pressure feeding the bubble also begins to decrease due to depletion of pressurized gas in accumulator 53. The maximum pool swell lift velocity tends to occur when the bubble has expanded to a pressure equal to the initial ambient pressure; following this, the pool continues to lift but at a decreasing velocity (i.e., the over-expansion phase). This ultimately leads to bubble depressurization and pool rebound (i.e., downward motion). Subsequent bubble oscillations occur within the cycle, but are damped at a rapid rate of decay as the gas rises through the liquid in the pool. The discharge valve 55 is closed to complete the operating cycle, thereby isolating the accumulator 53 to permit it to recharge with pressurized gas. Bypass flow through the closed solenoid valve, as described above, assures that any water swept into injector pipe 30 is cleared. In this regard there are no significant volumes in the injector system that are capable of trapping water; i.e., the system is designed to be self-draining (e.g., the accumulator may be tilted so as to be mounted above rather than below the discharge path into the steam generator). At this point the system is ready for another cycle of operation.

The effect of the liquid motion as described above is that a reciprocating radial (i.e., outward and then inward) flow of water is forced through the tube bundle, along with a corresponding reciprocating vertical flow, so as to clean the tubesheet surface, adjacent sections of tubes 12, and other parts of the heat exchanger.

There are numerous interdependent system operating parameters and dimensions, exemplary values for which are given below. It is to be understood, however, that these exemplary values for the parameters and dimensions are not to be construed as limiting the scope of the invention. The volume of accumulator 53 determines the volume of pressurized gas available to form gas bubble 31 for each actuation of solenoid valve 55. In effect, when valve 55 is opened, accumulator 53 discharges through valves 55, 57 and the surge volume 59, 30 into the cleaning liquid pool. In one exemplary system, the accumulator volume is 0.25 cubic feet. The pressure of the regulated gas delivered to accumulator 53 by regulator 51 is 1600 psig. The diameter of the opening of discharge valve 55 in part determines the rate at which the accumulated gas discharges as described and is, in the example, 2.0 inches. The opening speed of the valve, from fully closed to fully opened, is 0.3 seconds and is one of the factors determining the rise time of the gas pressure pulse delivered to the cleaning liquid pool. The surge volume in hose 59 and injector tube 30 also affects the gas pressure pulse rise time and is 0.1 cubic feet. The cross-section or flow area through both hose 59 and tube 30 is 3.5 square inches.

In the above example, the height of the cleaning liquid (e.g., water) in the steam generator is five feet with the level set between two support plates to avoid impact effects and minimize loads on these plates. Gas pressure in the steam generator above the cleaning liquid pool is 1 psig.

An exemplary system constructed as described above typically operates with a solenoid valve repetition rate of two cycles per minute. With this repetition rate, one gas pressure pulse is injected into the cleaning liquid every thirty seconds. This has been found to provide sufficient time for the effects of one gas pulse to substantially subside before the next pulse is applied. In addition, a cleaning liquid recirculation flow rate of 150 gpm is sufficient to remove the suspended foreign materials from the liquid.

From the foregoing description it will be appreciated that the invention makes available a novel method and apparatus for efficiently and effectively dislodging deposits from a tubesheet and adjacent tube section in a high pressure steam generator heat exchanger, as well as from other surfaces in the heat exchanger, by creating a rapidly reciprocating turbulent flow of cleaning liquid. The reciprocating flow is radially inward and outward along the tubesheet surface at a sufficient flow rate to dislodge the deposits. The reciprocating flow is produced by repetitively injecting controlled volumes of nitrogen or other gas at sufficiently low pulse rise times to avoid shock waves in the cleaning liquid but sufficient pressure to create an alternating expanding and retracting gas bubble adjacent the center of the top surface of the tubesheet. Loosened deposits and the like are removed from the cleaning liquid by means of a filtered cleaning liquid recirculation loop. Access to the steam generator for the recirculation loop and the gas injector is via a single handhole having a cover with appropriate fittings.

Having described a preferred embodiment of a new and improved method and apparatus for removing foreign matter from a heat exchanger tubesheet in accordance with the present invention, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. In a heat exchanger vessel of the type in which a bundle of flow tubes is supported on a tubesheet, a method for removing built-up components, such as sludge, adherent foreign matter and other unwanted contaminants, from the top surface of the tubesheet and from adjacent tube sections, said method comprising the steps of:

(a) establishing a pool of cleaning liquid in said vessel atop said tubesheet; and (b) periodically disturbing said cleaning liquid to create turbulent flow therein reciprocating radially inward and radially outward along said top surface and between said adjacent tube sections to dislodge the built-up components and suspend them in said cleaning liquid.

2. The method according to claim 1 further comprising the steps of:

(c) recirculating said cleaning liquid through an external flow loop; and (d) filtering the cleaning liquid flowing in said external flow loop to remove the suspended components from the recirculating liquid.

3. The method according to claim 2 wherein step (b) includes the step of:

(b.1) repetitively injecting pulses of a pressurized gas into said pool of cleaning liquid at least at one location just above said top surface, and shaping said pulses to have sufficiently slow rise times to prevent generation of pressure shock waves in said pool of cleaning liquid.

4. The method according to claim 3 wherein step (b.1) includes injecting said pulses of pressurized gas at said one location substantially radially centered with respect to said tubesheet to form a bubble of said gas that reciprocatingly increases and decreases radially in volume in response to said pulses to disturb said cleaning liquid and create said turbulent flow.

5. The method according to claim 4 wherein the flow rate of said turbulent flow created in step (b) is at least one to two feet per second.

6. The method according to claim 4 wherein an annular shroud is located in said vessel about said tube bundle to define an annulus region between the shroud and the vessel wall, said method further comprising the step of:

(e) in response to the reciprocating increase and decrease in gas bubble volume, causing the cleaning liquid to flow in a correspondingly reciprocating flow pattern up and down within said annulus region to remove built-up components on surfaces in that region.

7. The method according to claim 6 further comprising the step of:

returning cleaning liquid to said vessel from said external flow loop at a location in said annulus region and in a direction substantially tangential and generally downward along the vessel wall.

8. The method according to claim 7 wherein the flow of cleaning liquid to and from said external flow loop, and the injection of said gas pulses, are all conducted via a common opening in said vessel wall.

9. The method according to claim 6 wherein said vessel includes a plurality of intermediate support plates for said flow tubes disposed at spaced vertical locations, and wherein step (a) includes establishing said pool of cleaning liquid with a surface level disposed intermediate two of said support plates to prevent impact of said surface level against said support plates in response to the increases of volume of said gas bubble.

10. The method according to claim 4 wherein step (b.1) includes the steps of:

cyclically charging a known accumulator volume with said gas at a predetermined pressure and discharging said gas from said accumulator volume;

establishing a surge volume in a flow path between said accumulator volume and said at least one location in said cleaning liquid pool; and wherein the discharging of said gas from said accumulator volume is via a path through said surge volume to said at least one location in said vessel.

11. The method according to claim 10 further comprising the step of filling said surge volume with said gas at ambient pressure during charging of said accumulator volume, wherein said ambient pressure is the pressure in said cleaning liquid pool at said at least one location.

12. The method according to claim 11 wherein the step of cyclically charging and discharging includes, respectively, cyclically closing and opening a discharge valve disposed between said accumulator volume and said surge volume.

13. The method according to claim 12 wherein the step of filling said surge volume includes flowing said gas from said accumulator volume to said surge volume through a bypass path in said discharge valve when closed.

14. The method according to claim 12 wherein step (b.1) includes opening said valve sufficiently slowly and providing said surge volume sufficiently large to prevent the creation of shock waves by the discharge of pressurized gas out of said accumulator volume.

15. The method according to claim 4 wherein said vessel includes a plurality of intermediate support plates for said flow tubes disposed at spaced vertical locations, and wherein step (a) includes establishing said pool of cleaning liquid with a surface level disposed intermediate two of said support plates to prevent impact of said surface level against said support plates in response to the increases of volume of said gas bubble.

16. The method according to claim 1 wherein step (b) includes the step of:

(b.1) repetitively injecting pulses of a pressurized gas into said pool of cleaning liquid at least at one location just above said top surface, and shaping said pulses to have sufficiently slow rise times to prevent generation of pressure shock waves in said pool of cleaning liquid.

17. The method according to claim 16 wherein step (b.1) includes the steps of:

cyclically charging a known accumulator volume with said gas at a predetermined pressure and discharging said gas from said accumulator volume;

establishing a surge volume in a flow path between said accumulator volume and said at least one location in said cleaning liquid pool; and wherein the discharging of said gas from said accumulator volume is via a path through said surge volume to said at least one location in said vessel.

18. The method according to claim 17 further comprising a the step of filling said surge volume with said gas at ambient pressure during charging of said accumulator volume, wherein said ambient pressure is the pressure in said cleaning liquid pool at said at least one location.

19. The method according to claim 18 wherein the step of cyclically charging and discharging includes, respectively, cyclically closing and opening a discharge valve disposed between said accumulator volume and said surge volume.

20. The method according to claim 19 wherein the step of filling said surge volume includes flowing said gas from said accumulator volume to said surge volume through a bypass path in said discharge valve when closed.

21. The method according to claim 19 wherein step (b.1) includes opening said valve sufficiently slowly and providing said surge volume sufficiently large to prevent the discharging of pressurized gas out of said accumulator volume from creating said shock waves in said pool of cleaning liquid.

22. In a heat exchanger vessel of the type wherein a bundle of flow tubes is supported on a tubesheet, apparatus for removing built-up components such as sludge, adherent foreign matter and other unwanted contaminants from the top surface of the tubesheet and from tube sections adjacent the tubesheet with a pool of cleaning liquid disposed in said vessel atop the tubesheet, said apparatus comprising:

turbulence inducing means for inducing turbulent flow reciprocating radially inward and radially outward along said top surface of said tubesheet to loosen and dislodge said built-up components and place them in suspension in the cleaning liquid; and means for flowing cleaning liquid with said suspended components out of said vessel.

23. The apparatus according to claim 22 wherein said means for flowing includes a recirculation loop located externally of said vessel and connected to the vessel interior via a vessel outflow tube and a vessel inflow tube, said recirculation loop including pump means for establishing a continuous flow of said cleaning liquid through said vessel and said recirculation loop, and filter means for removing the suspended components from cleaning liquid flowing through said loop.

24. The apparatus according to claim 23 wherein said turbulence inducing means comprises means for repetitively injecting pulses of a predetermined gas into said pool of cleaning liquid at least at one location just above said top surface, and shaping means for shaping said pulses to have sufficiently slow rise times to prevent generation of pressure shock waves in said pool of cleaning liquid.

25. The apparatus according to claim 24 wherein said means for injecting pulses includes means for issuing said pulses into said pool of cleaning liquid at said one location substantially radially centered with respect to said tubesheet to form a bubble of said gas that reciprocatingly increases and decreases radially in volume in response to said pulses to disturb said cleaning liquid and create said turbulent flow.

26. The apparatus according to claim 25 further comprising an annular shroud located in said vessel about said tube bundle to define an annulus region between the shroud and the vessel wall, and means responsive to the reciprocating increase and decrease in gas bubble volume for causing the cleaning liquid to flow in a correspondingly reciprocating flow pattern up and down in said annulus region to remove built-up components on surfaces in that region.

27. The apparatus according to claim 26 further comprising means for returning the cleaning liquid to said vessel from said external loop at a location in said annulus region and in a direction substantially tangential and generally downward about said shroud.

28. The apparatus according to claim 25 wherein said means for repetitively injecting includes:

a known accumulator volume;

means for cyclically charging said accumulator volume with said gas at a predetermined pressure and discharging said gas from said accumulator volume;

a surge volume located between said accumulator volume and said at least one location in said cleaning liquid pool;

wherein the discharging of said gas from said accumulator volume is via a flow path through said surge volume to said at least one location.

29. The apparatus according to claim 28 further comprising bypass means for filling said surge volume with said gas at ambient pressure during charging of said accumulator volume, wherein said ambient pressure is the pressure within said cleaning liquid pool at said at least one location.

30. The apparatus according to claim 29 wherein said means for cyclically charging and discharging includes selectively actuable discharge valve means disposed between said accumulator volume and said surge volume, and means for cyclically closing and opening said discharge valve means.

31. The apparatus according to claim 30 wherein said means for filling said surge volume comprises a bypass path in said discharge valve means for permitting pressurized gas to flow from said accumulator volume to said surge volume when said discharge valve means is closed.

32. The apparatus according to claim 30 wherein said turbulence inducing means further includes means for opening said discharge valve means sufficiently slowly to prevent said discharging of pressurized gas out of said accumulator volume from creating pressure shock waves in said pool of liquid.

33. The apparatus according to claim 25 wherein said means for flowing includes a recirculation loop located externally of said vessel and connected to the vessel interior via a vessel outflow tube and a vessel inflow tube, said recirculation loop including pump means for establishing a continuous flow of said cleaning liquid through said vessel and said recirculation loop, and filter means for removing the suspended components from cleaning liquid flowing through said loop; and wherein said means for repetitively injecting includes:

a known accumulator volume;

means for cyclically charging said accumulator volume with said gas at a predetermined pressure and discharging said gas from said accumulator volume;

a surge volume located between said accumulator volume and said at least one location in said cleaning liquid pool;

wherein the discharging of said gas from said accumulator volume is via a flow path through said surge volume to said at least one location.

34. The apparatus according to claim 33 further comprising bypass means for filling said surge volume with said gas at ambient pressure during charging of said accumulator volume, wherein said ambient pressure is the pressure within said cleaning liquid pool at said at least one location.

35. The apparatus according to claim 34 wherein said means for cyclically charging and discharging includes selectively actuable discharge valve means disposed between said accumulator volume and said surge volume, and means for cyclically closing and opening said discharge valve means.

36. The apparatus according to claim 35 wherein said means for filling said surge volume comprises a bypass path in said discharge valve for permitting pressurized gas to flow from said accumulator volume to said surge volume when said discharge valve means is closed.

37. The apparatus according to claim 35 wherein said turbulence inducing means further includes means for opening said discharge valve means sufficiently slowly to prevent said discharging of pressurized gas out of said accumulator volume from creating said pressure shock waves in said pool of liquid.

* * * * *